US011280519B2

(12) United States Patent
Hutchison et al.

(10) Patent No.: US 11,280,519 B2
(45) Date of Patent: Mar. 22, 2022

(54) WATER HEATER WITH OPTIMIZED DIP TUBE

(71) Applicant: Haier US Appliance Solutions, Inc., Wilmington, DE (US)

(72) Inventors: Gregory L. Hutchison, Shelbyville, KY (US); Craig Iung-Pei Tsai, Louisville, KY (US); Timothy David Gantt, Goshen, KY (US); Alan George Constance, Jeffersonville, IN (US); Jonathan D. Nelson, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/925,754

(22) Filed: Jul. 10, 2020

(65) Prior Publication Data

US 2022/0011016 A1 Jan. 13, 2022

(51) Int. Cl.

| | |
|---|---|
| ***F24H 9/12*** | (2006.01) |
| ***F24H 9/00*** | (2006.01) |
| ***F28D 20/00*** | (2006.01) |
| ***F24H 9/20*** | (2006.01) |

(52) U.S. Cl.

CPC ..... *F24H 9/124* (2013.01); *F24H 9/0015* (2013.01); *F24H 9/2035* (2013.01); *F28D 2020/0069* (2013.01); *Y10T 137/86372* (2015.04)

(58) Field of Classification Search

CPC ..... B05B 15/30; F24H 9/0015; F24H 9/124; F24H 9/2035; F28D 2020/0069; Y10T 137/86372; Y10T 137/86348

USPC ..... 137/592; 222/382

See application file for complete search history.

(56) References Cited

U.S. PATENT DOCUMENTS

| | | | | |
|---|---|---|---|---|
| 1,716,692 | A * | 6/1929 | Gundlach | F16K 15/063 137/592 |
| 2,123,809 | A * | 7/1938 | Seitz | F24H 9/124 137/592 |
| 3,776,456 | A * | 12/1973 | Eising | F24H 9/124 236/93 R |
| 4,505,231 | A * | 3/1985 | Syler | F24H 9/0042 122/159 |
| 5,137,053 | A | 8/1992 | Kale | |
| 6,059,152 | A * | 5/2000 | Mayfield | B05B 11/0037 222/382 |
| 6,138,614 | A * | 10/2000 | Shropshire | F28D 20/0039 122/13.3 |
| 7,861,678 | B2 | 1/2011 | McClellan | |
| 9,335,066 | B2 * | 5/2016 | Humphrey | F24H 1/186 |
| 10,288,316 | B1 * | 5/2019 | Currey | F24H 9/0015 |

(Continued)

FOREIGN PATENT DOCUMENTS

| | | | | |
|---|---|---|---|---|
| AT | 307305 B | * | 5/1973 | B65D 83/32 |

*Primary Examiner* — Edelmira Bosques
*Assistant Examiner* — Benjamin Trettel
(74) *Attorney, Agent, or Firm* — Dority & Manning, P.A.

(57) ABSTRACT

A water heater appliance includes a tank extending along a vertical direction between a top end wall and a bottom end wall and a dip tube extending from an inlet end to an outlet end. The inlet end of the dip tube is coupled to a cold water inlet in the top end wall of the tank. The outlet end of the dip tube may be positioned in a bottom corner of the tank and/or positioned at an outer perimeter of the bottom end wall.

15 Claims, 4 Drawing Sheets

(56) References Cited

U.S. PATENT DOCUMENTS

| | | | | |
|---|---|---|---|---|
| 2008/0302315 | A1* | 12/2008 | McClellan | F22D 7/04<br>122/451 R |
| 2016/0040906 | A1* | 2/2016 | Aguilar | F24H 1/201<br>392/451 |
| 2018/0051908 | A1 | 2/2018 | Hutchison | |

* cited by examiner

WATER HEATER WITH OPTIMIZED DIP TUBE

FIELD OF THE INVENTION

The present subject matter relates generally to water heater appliances.

BACKGROUND OF THE INVENTION

Water heater appliances generally include a tank wrapped in insulation and enclosed within an outer shell. Typically, the tank can be formed of metal, such as steel, with an inner lining or coating such as glass or enamel. Such water heater appliances typically include assorted tubes attached to the tank, such as a dip tube for introduction of cold water into the tank.

Conventional dip tubes for water heater appliances are standard, straight pipes with open ends. These dip tubes deliver cold water to a lower portion of the tank, but, due to clearances and manufacturing tolerances, cannot directly reach the very lowest portion of the tank. Additionally, the open end of the dip tube pipe concentrates the outflow of cold water from the dip tube in a single location at a relatively high velocity.

As such, there is a need for a water heater that can more efficiently supply cold water to the tank. Additionally, features for more precisely locating the inflow of cold water to the tank would be beneficial.

BRIEF DESCRIPTION OF THE INVENTION

Aspects and advantages of the invention will be set forth in part in the following description, or may be apparent from the description, or may be learned through practice of the invention.

In one exemplary embodiment, a water heater appliance is provided. The water heater appliance includes a tank. The tank includes a top end wall and a bottom end wall spaced from the top end wall along a vertical direction. The tank also includes a cylindrical wall extending along the vertical direction between the top end wall and the bottom end wall. A bottom corner of the tank is defined by an intersection of the cylindrical wall and the bottom end wall. A dip tube extends from an inlet end of the dip tube coupled to a cold water inlet in the top end wall to an outlet end of the dip tube positioned in the bottom corner of the tank.

In another exemplary embodiment, a water heater appliance is provided. The water heater appliance includes a tank extending along a vertical direction between a top end wall and a bottom end wall. The water heater appliance also includes a dip tube extending from an inlet end to an outlet end. The inlet end of the dip tube is coupled to a cold water inlet in the top end wall of the tank and the outlet end of the dip tube is positioned at an outer perimeter of the bottom end wall.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
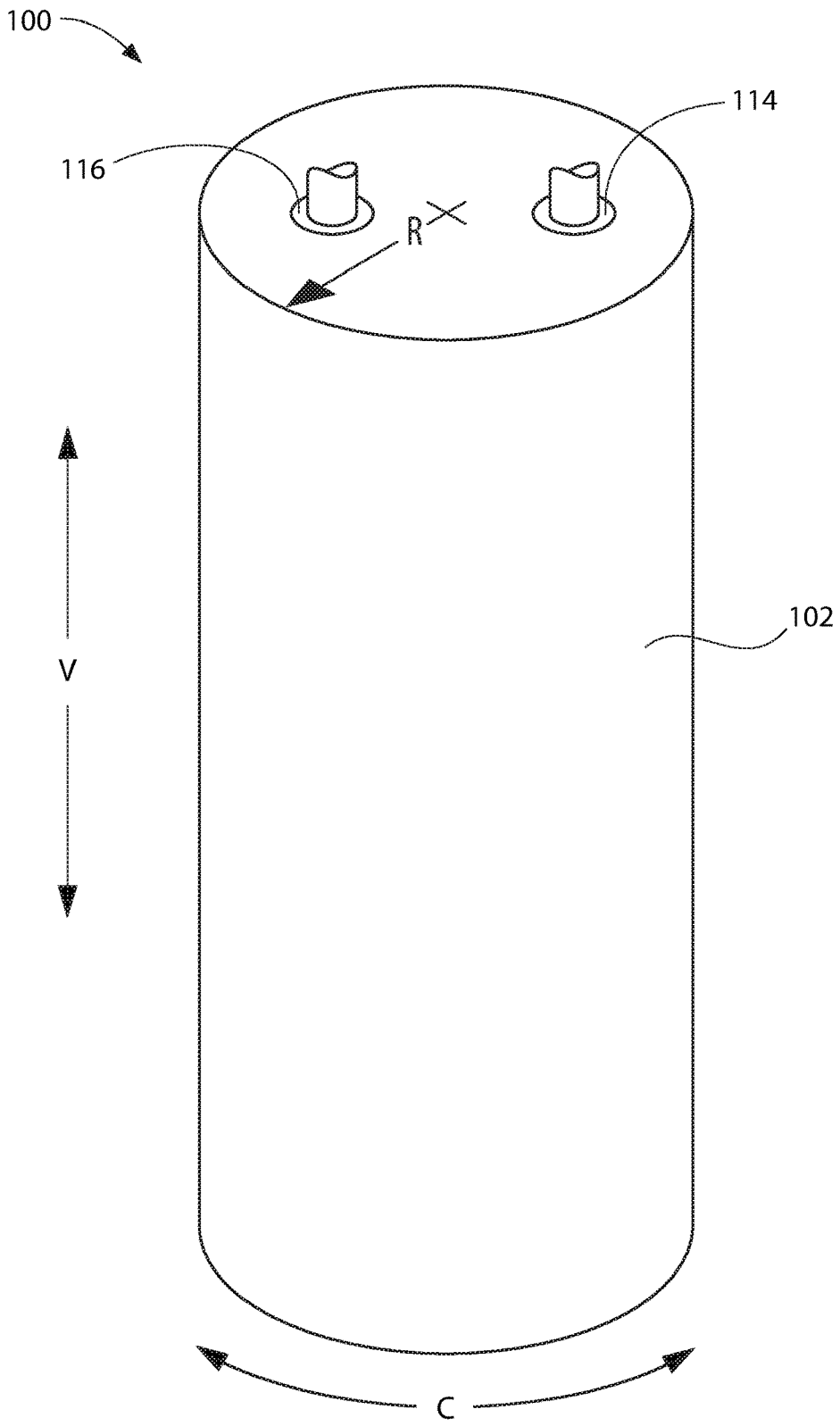
FIG. 1 provides a perspective view of a water heater appliance according to at least one exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Although exemplary embodiments of the present disclosure will be described generally in the context of a water heater appliance for purposes of illustration, one of ordinary skill in the art will readily appreciate that embodiments of the present disclosure may be applied to any style or type of heater for a liquid and are not limited to water heaters or heating systems for water.

As may be seen in, e.g., FIG. 1, water heater appliance 100 defines a vertical direction V, a circumferential direction C, and a radial direction R. The vertical direction V is generally parallel to a longitudinal axis of the water heater appliance 100. The circumferential direction C extends around the longitudinal axis of the water heater appliance 100. The radial direction R is generally perpendicular to the longitudinal axis of the water heater appliance 100.

Figure 2:
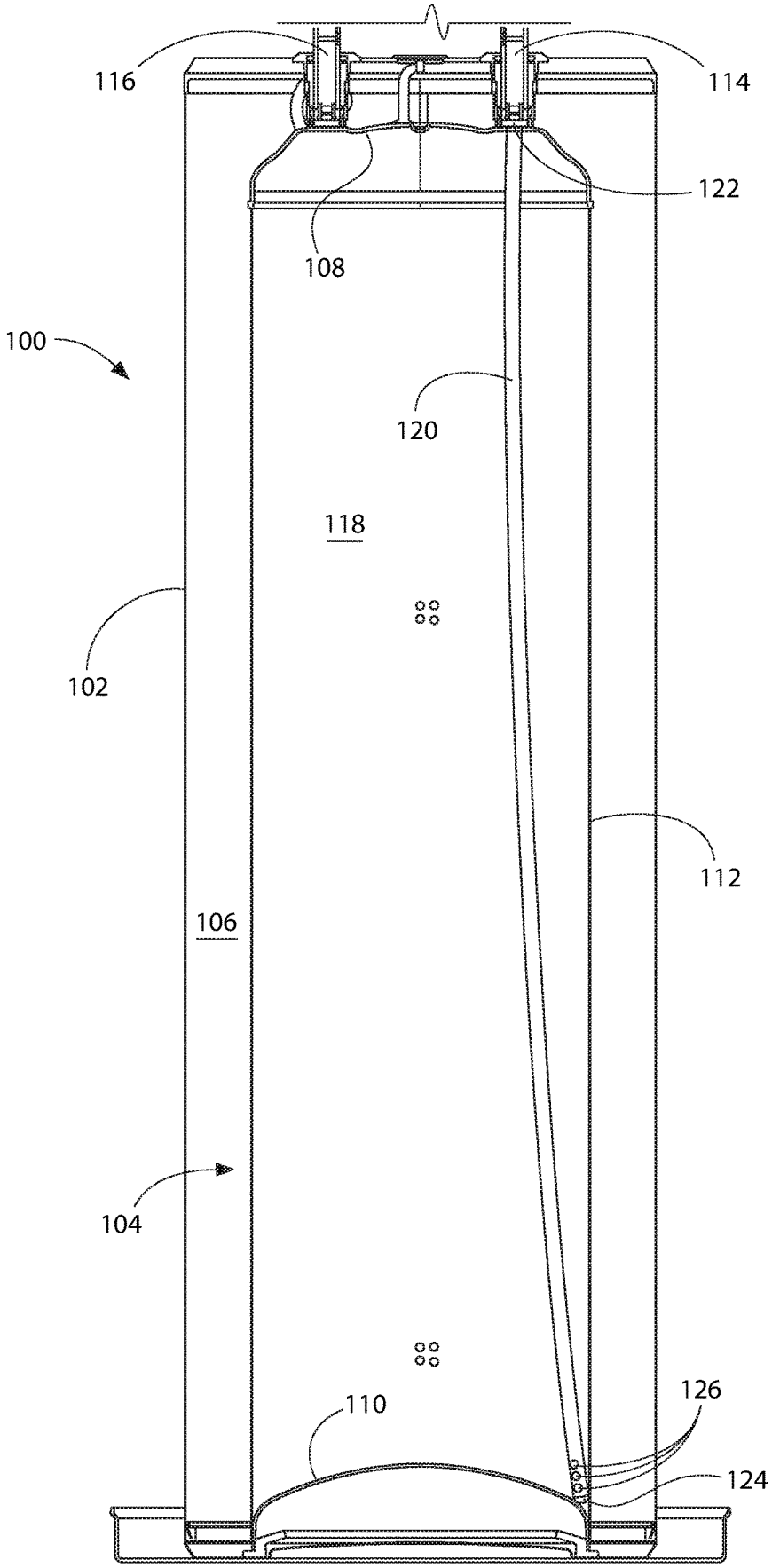
FIG. 2 provides a section view of the water heater appliance of FIG. 1.

As illustrated for example in FIGS. 1 and 2, water heater appliance 100 may include an outer shell 102 and a tank 104 within the outer shell 102. Although not specifically illustrated, it should be understood that the space 106 between the outer shell 102 and the tank 104 may be filled with thermal insulation, as those of ordinary skill in the art will recognize. The tank 104 may include a top end wall 108, a bottom end wall 110 spaced from the top end wall 100 along vertical direction V, and a cylindrical wall 112 extending along vertical direction V between the top end wall 108 and the bottom end wall 110. Some exemplary embodiments of tank 104, and in particular cylindrical wall 112 thereof, may also include various ports, inlets, and other fittings for connecting, e.g., pipes and valves, thereto. For example as illustrated in FIGS. 1 and 2, some exemplary embodiments of tank 104 may include a cold water inlet 114 and hot water outlet 116, which may be provided, e.g., in top end wall 108 as illustrated in FIG. 2.

As illustrated in the exemplary embodiment of FIG. 2, the tank 104 may further include an interior volume 118 defined by the top end wall 108, the bottom end wall 110, and the cylindrical wall 112, for example as illustrated in FIG. 2. The interior volume 118 of the tank 104 may be adapted for storing potable water.

The cold water inlet 114 and hot water outlet 116 may each be adapted for connection to the plumbing system of a building such as a residence. Cold water inlet 114 is adapted for connection to a pipe supplying water in an initial non-heated, i.e., "cold," state, e.g., as supplied from the water supply line of a home or other building. In order to provide thermal stratification, e.g., with colder water at or near the bottom end wall 110 of the tank 104 and hotter water at or near the top end wall 108 of the tank 104, and in particular at the hot water outlet 116 formed in the top end wall 108, a dip tube 120 may be provided. In some embodiments, the dip tube 120 may extend from the cold water inlet 114 to or towards the bottom end wall 110 of the tank 104. For example, the dip tube 120 may extend from an inlet end 122 which is coupled to the cold water inlet 114 in the top end wall 108 to an outlet end 124. The outlet end 124 is preferably positioned at the lowest possible point, e.g., farthest away from the top end wall 108, in the tank 104 to provide thermal stratification.

Figure 3:
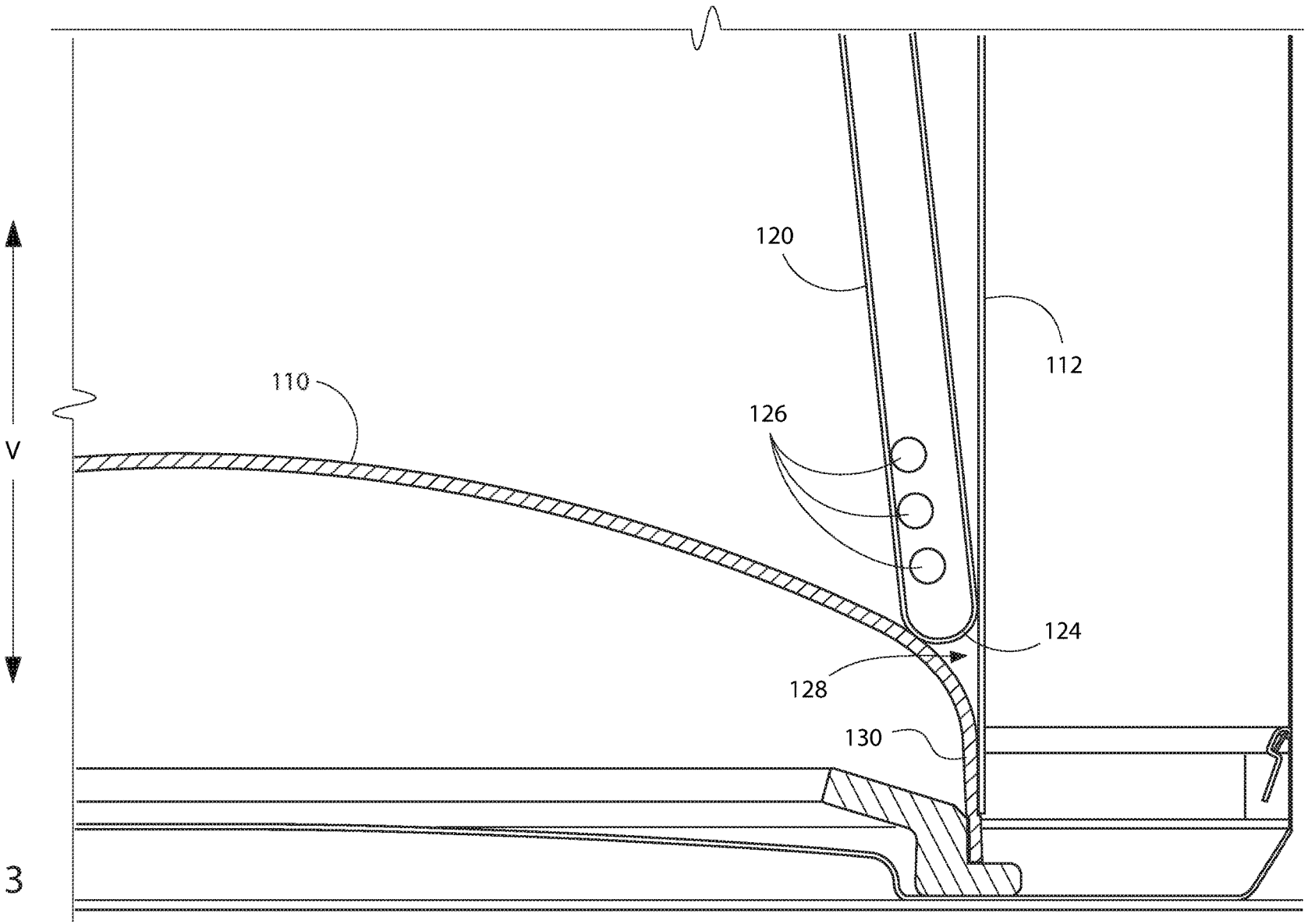
FIG. 3 provides an enlarged view of a portion of the water heater appliance of FIG. 1.

As may be seen in FIG. 3, the tank 104 may include a bottom corner 128 defined by an intersection of the cylindrical wall 112 and the bottom end wall 110. Also as may be seen in FIG. 3, the bottom end wall 110 may include an outer perimeter 130. In various embodiments, the outlet end 124 of the dip tube 120 may be positioned in the bottom corner 128 of the tank 104 and/or at the outer perimeter 130 of the bottom end wall 110. For example, as illustrated in FIG. 3, the bottom end wall 110 may intersect the cylindrical wall 112 at the outer perimeter 130 of the bottom end wall 110, such that the bottom corner 128 of the tank 104 is at least partially defined by the outer perimeter 130 of the bottom end wall 110. Further, in at least some example embodiments, the outlet end 124 of the dip tube 120 may be in contact with the bottom end wall 110 and in contact with the cylindrical wall 112, e.g., as illustrated in FIG. 3.

In some embodiments, the bottom end wall 110 may be curved, such as convex curved, e.g., as illustrated in FIGS. 2 and 3. Additionally, as may also be seen in FIGS. 2 and 3, the outlet end 124 of the dip tube 120 may be curved, such as convex curved. For example, the outlet end 124 of the dip tube 120 may be a convex hemispherical outlet end 124, e.g., as illustrated in FIGS. 2 and 3. Such curvature, e.g., opposing convex curvature, of the bottom end wall 110 of the tank 104 and the outlet end 124 of the dup tube 120 may promote installation of the dip tube 120 such that the outlet end 124 is at a low point within the tank 104. For example, the dip tube 120 may initially be inserted straight down (e.g., along the vertical direction V towards the bottom end wall 110) into the tank 104 from the cold water inlet 114 until the outlet end 124 of the dip tube 120 encounters the bottom end wall 110, at which point the curvature of the bottom end wall 110 and/or of the outlet end 124 of the dip tube 120 may guide the outlet end 124 outward, e.g., along the radial direction R, towards the outer perimeter 130 of the bottom end wall 110 and/or the cylindrical wall 112. Thus, the outlet end 124 of the dip tube 120 may be deflected or offset away from the cold water inlet 114 and the hot water outlet 116 of the tank 104 along the radial direction R. As best seen in FIG. 2, as a result of such deflection, when the dip tube 120 is in a fully installed position, the dip tube 120 may be curved and the outlet end 124 of the dip tube 120 may be radially offset from the inlet end 122 of the dip tube 120, such as radially outward (e.g., away from the center of the tank 104) of the inlet end 122 of the dip tube 120. Where the section illustrated in FIG. 2 is taken in a vertical-radial plane defined by the vertical direction V and the radial direction R, the curved configuration of the dip tube 120 illustrated in FIG. 2 and described hereinabove means that the dip tube 120 is curved in the vertical-radial plane.

In some embodiments, the dip tube 120 may be formed of a flexible material. For example, the material of the dip tube 120 may be sufficiently flexible to bend during installation from an initially straight configuration to a curved configuration, such as the curved configuration illustrated in FIG. 2, without damaging the dip tube 120 and/or the tank 104, such as the bottom end wall 110 thereof. Suitable flexible materials may include plastic materials such as polysulfone, polypropylene, or polyethylene, e.g., cross-linked polyethylene (PEX).

In at least some embodiments, the dip tube 120 may be longer than the tank 104. For example, the bottom end wall 110 may be spaced from the top end wall 108 along the vertical direction V by a first distance. Further, the dip tube 120 may define a length from the inlet end 122 to the outlet end 124, and the length of the dip tube 120 may be greater than the first distance. For example, as may be seen in FIG. 2, the first distance may be a straight line distance and the length of the dip tube 120 may be defined along the curve of the dip tube 120, such that the length of the curved dip tube 120 is longer than the straight line first distance.

Figure 4:
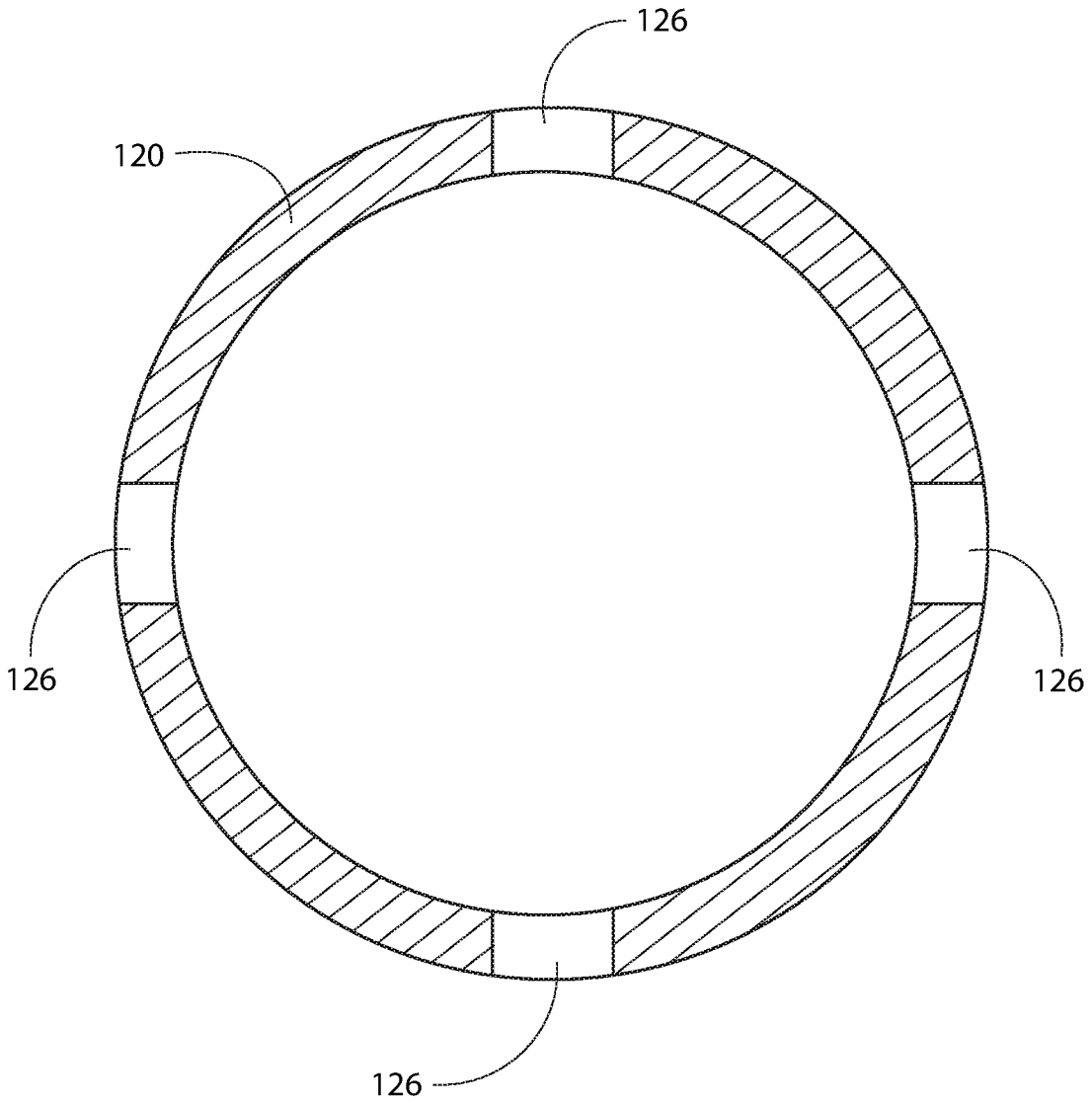
FIG. 4 provides a section view of a dip tube of a water heater appliance according to one or more exemplary embodiments of the present subject matter.

As best seen in FIGS. 3 and 4, the dip tube 120 may include a plurality of outlets 126 formed at or near the outlet end 124 thereof. In some embodiments, the plurality of outlets 126 may include twelve outlets, e.g., four sets of three outlets. For example, as may be seen in FIG. 3, each set of three outlets 126 may be aligned along a longitudinal axis of the dip tube 120. Also by way of example, as illustrated in FIG. 4, the four sets of outlets 126 may be spaced apart around the circumference of the dip tube 120, such as equidistantly spaced around the circumference of the dip tube 120 as illustrated in FIG. 4. Including multiple outlets 126 may advantageously provide a relatively low velocity for the inflowing cold water, which helps to avoid or minimize vertical mixing of water within tank 104.

Throughout this disclosure, features illustrated or described as part of one embodiment can be used with another embodiment to yield a still further embodiment. This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A water heater appliance, comprising:

a tank, the tank comprising:

a top end wall;

a bottom end wall spaced from the top end wall along a vertical direction;

a cylindrical wall extending along the vertical direction between the top end wall and the bottom end wall; and a bottom corner of the tank defined by an intersection of the cylindrical wall and the bottom end wall; and a dip tube comprising a cylindrical portion having a generally constant diameter, the cylindrical portion extending from an inlet end of the dip tube coupled to a cold water inlet in the top end wall to a convex hemispherical outlet end of the dip tube positioned in the bottom corner of the tank, wherein the cylindrical portion of the dip tube directly adjoins the convex hemispherical outlet end of the dip tube.

2. The water heater appliance of claim 1, wherein the bottom end wall is curved.

3. The water heater appliance of claim 1, wherein the bottom end wall is convex.

4. The water heater appliance of claim 1, wherein the outlet end of the dip tube is radially offset from the inlet end of the dip tube.

5. The water heater appliance of claim 1, wherein the dip tube further comprises a plurality of outlets in the cylindrical portion of the dip tube near the convex hemispherical outlet end of the dip tube.

6. The water heater appliance of claim 1, wherein the bottom end wall is spaced from the top end wall along the vertical direction by a first distance, the dip tube defines a length of the dip tube from the inlet end of the dip tube to the convex hemispherical outlet end of the dip tube, and the length of the dip tube is greater than the first distance.

7. The water heater appliance of claim 1, wherein the dip tube is curved.

8. The water heater appliance of claim 1, wherein the convex hemispherical outlet end of the dip tube is in contact with the bottom end wall and in contact with the cylindrical wall.

9. A water heater appliance, comprising:

a tank extending along a vertical direction between a top end wall and a bottom end wall; and a dip tube comprising a cylindrical portion having a generally constant diameter, the cylindrical portion extending from an inlet end to a convex hemispherical outlet end having approximately the same diameter as the cylindrical portion of the dip tube;

wherein the inlet end of the dip tube is coupled to a cold water inlet in the top end wall of the tank and the convex hemispherical outlet end of the dip tube is positioned at an outer perimeter of the bottom end wall.

10. The water heater appliance of claim 9, wherein the bottom end wall is curved.

11. The water heater appliance of claim 9, wherein the bottom end wall is convex.

12. The water heater appliance of claim 9, wherein the convex hemispherical outlet end of the dip tube is radially offset from the inlet end of the dip tube.

13. The water heater appliance of claim 9, wherein the dip tube further comprises a plurality of outlets in the cylindrical portion of the dip tube near the convex hemispherical outlet end of the dip tube.

14. The water heater appliance of claim 9, wherein the bottom end wall is spaced from the top end wall along the vertical direction by a first distance, the dip tube defines a length of the dip tube from the inlet end of the dip tube to the convex hemispherical outlet end of the dip tube, and the length of the dip tube is greater than the first distance.

15. The water heater appliance of claim 9, wherein the dip tube is curved.

* * * * *